US011388787B2

(12) United States Patent
Carcano et al.

(10) Patent No.: US 11,388,787 B2
(45) Date of Patent: Jul. 12, 2022

(54) CONVECTION SYSTEM FOR EMPLOYMENT WITH AN RF OVEN

(71) Applicant: ILLINOIS TOOL WORKS INC., Glenview, IL (US)

(72) Inventors: Marco Carcano, Senago (IT); Michele Sclocchi, San Donato Milanese (IT); Michele Gentile, Jesi (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 947 days.

(21) Appl. No.: 15/803,878

(22) Filed: Nov. 6, 2017

(65) Prior Publication Data

US 2018/0152996 A1 May 31, 2018

Related U.S. Application Data

(60) Provisional application No. 62/428,106, filed on Nov. 30, 2016.

(51) Int. Cl.

| | |
|---|---|
| ***H05B 6/64*** | (2006.01) |
| ***H05B 6/68*** | (2006.01) |
| ***H05B 6/76*** | (2006.01) |
| ***F24C 15/32*** | (2006.01) |

(52) U.S. Cl.

CPC ..... *H05B 6/6473* (2013.01); *F24C 15/325* (2013.01); *H05B 6/6494* (2013.01); *H05B 6/687* (2013.01); *H05B 6/76* (2013.01)

(58) Field of Classification Search

CPC ..... H05B 6/00; F24C 15/00

See application file for complete search history.

(56) References Cited

FOREIGN PATENT DOCUMENTS

| | | | |
|---|---|---|---|
| EP | 2110612 | A2 | 10/2009 |
| EP | 2527745 | A1 | 11/2012 |
| GB | 2065867 | A | 7/1981 |
| JP | S6314016 | A | 1/1988 |
| JP | H0217323 | A | 1/1990 |

OTHER PUBLICATIONS

International Search Report and Written Opinion of PCT/US2017/060286 dated Feb. 16, 2018, all enclosed pages cited.

*Primary Examiner* — Justin C Dodson

(74) *Attorney, Agent, or Firm* — Burr & Forman LLP

(57) ABSTRACT

An air circulation system for an oven includes a plenum disposed proximate to the cooking chamber, an airflow generator configured to draw air from the cooking chamber through a chamber outlet port and discharge the air into the plenum, and an air heater configured to heat at least some of the air in the plenum prior to a portion of the air entering the cooking chamber from the plenum via air delivery orifices. The chamber outlet port includes outlet perforations combining to form a first geometric shape centered on an axis of the airflow generator. The air delivery orifices include a first set of inlet perforations and a second set of inlet perforations. The first and second sets of inlet perforations combine to form respective second and third geometric shapes that are disposed on opposite sides of the outlet perforations. The second and third geometric shapes are different than the first geometric shape.

16 Claims, 6 Drawing Sheets

CONVECTION SYSTEM FOR EMPLOYMENT WITH AN RF OVEN

CROSS REFERENCE TO RELATED APPLICATIONS

This application claims priority to U.S. application No. 62/428,106 filed Nov. 30, 2016, the entire contents of which are incorporated by reference in its entirety.

TECHNICAL FIELD

Example embodiments generally relate to ovens and, more particularly, relate to an oven that uses radio frequency (RF) heating along with convection heating and the corresponding structures for providing the same.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for applying heat to the food product in the oven. Moreover, such improvements may necessitate new arrangements for supporting or operating such structures or systems.

In an example embodiment, an oven is provided. The oven includes a cooking chamber configured to receive a food product and an air circulation system configured to provide heated air into the cooking chamber. The air circulation system includes a plenum disposed proximate to the cooking chamber and separated from the cooking chamber by a back wall of the cooking chamber, an airflow generator configured to draw air from the cooking chamber through a chamber outlet port and discharge the air into the plenum, and an air heater configured to heat at least some of the air in the plenum prior to a portion of the air entering the cooking chamber from the plenum via air delivery orifices. The chamber outlet port includes outlet perforations combining to form a first geometric shape centered on an axis of the airflow generator. The air delivery orifices include a first set of inlet perforations and a second set of inlet perforations. The first and second sets of inlet perforations combine to form respective second and third geometric shapes that are disposed on opposite sides of the outlet perforations. The second and third geometric shapes are different than the first geometric shape.

In an example embodiment, an air circulation system for an oven having a cooking chamber configured to receive a food product is provided. The air circulation system includes a plenum disposed proximate to the cooking chamber and separated from the cooking chamber by a back wall of the cooking chamber, an airflow generator configured to draw air from the cooking chamber through a chamber outlet port and discharge the air into the plenum, and an air heater configured to heat at least some of the air in the plenum prior to a portion of the air entering the cooking chamber from the plenum via air delivery orifices. The chamber outlet port includes outlet perforations combining to form a first geometric shape centered on an axis of the airflow generator. The air delivery orifices include a first set of inlet perforations and a second set of inlet perforations. The first and second sets of inlet perforations combine to form respective second and third geometric shapes that are disposed on opposite sides of the outlet perforations. The second and third geometric shapes are different than the first geometric shape.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
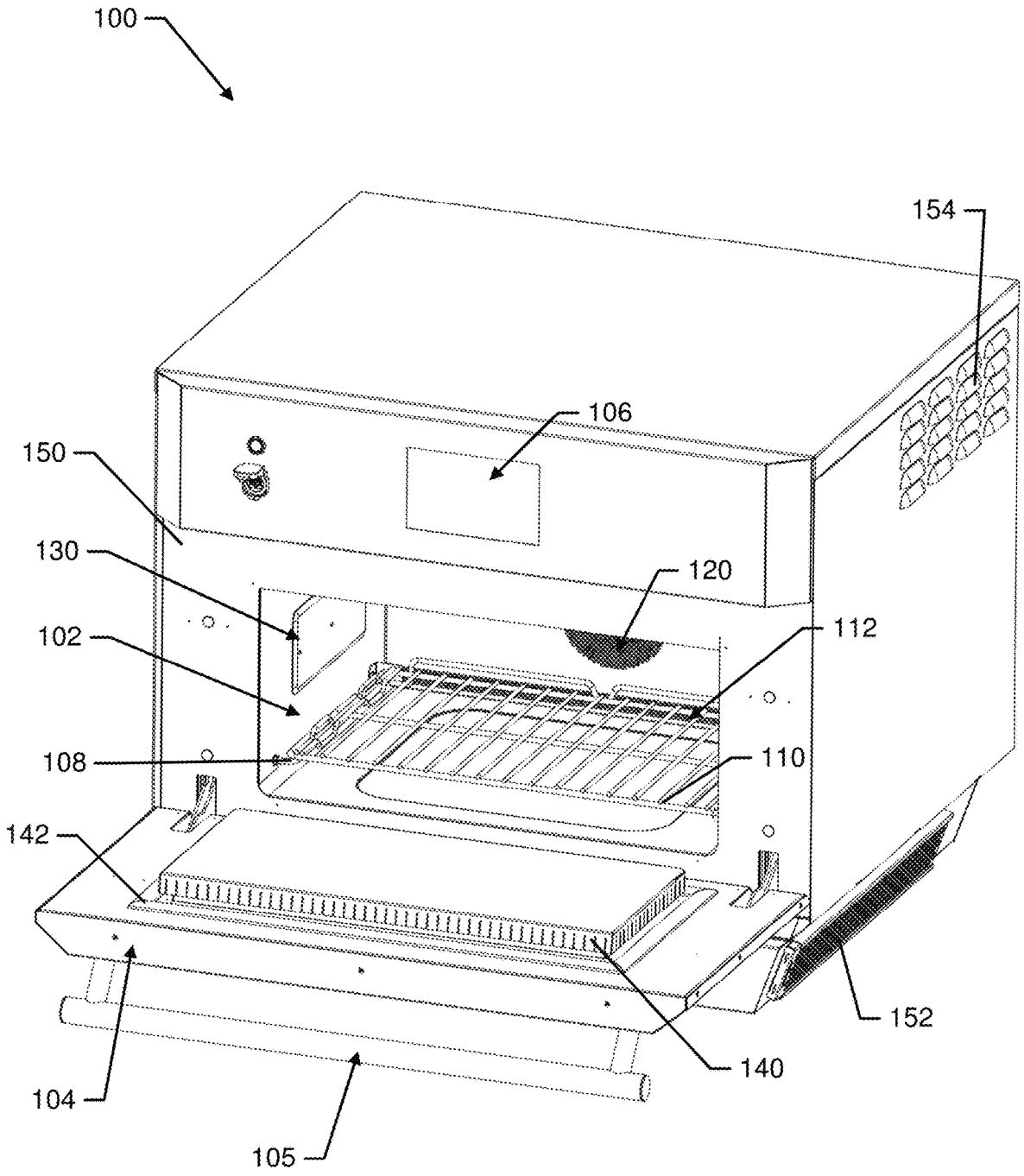
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly, based on the application of controllable RF energy, and also enable the food to be browned by providing hot air into the oven with a convection system as described herein.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the ground. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. As such, air drawn into the inlet array 152 can reliably be expected to be air at ambient room temperature, and not recycled, expelled cooling air.

Figure 2:
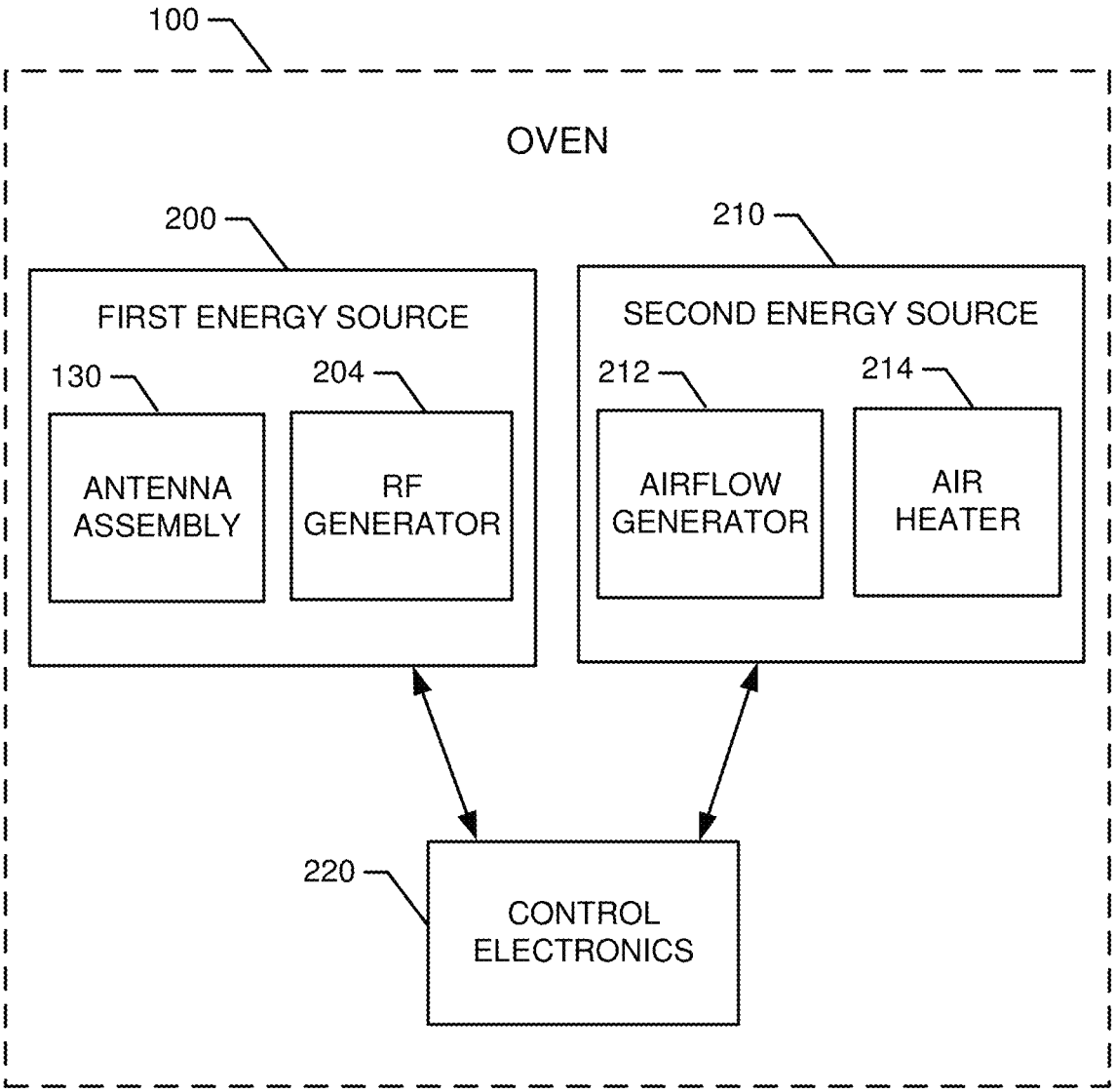
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

Figure 3:
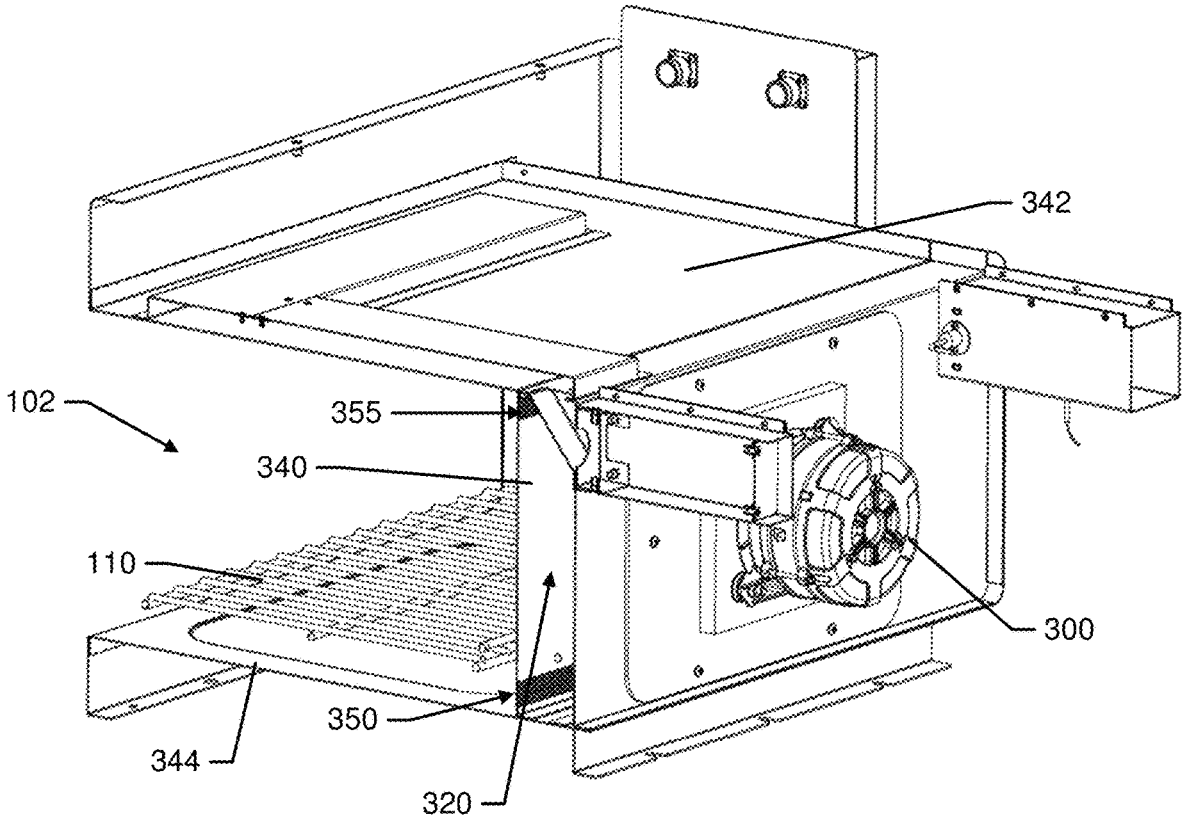
FIG. 3 shows a perspective view of a cooking chamber of the oven in cross section taken along a plane that passes from front to back according to an example embodiment.

As discussed above, the first air circulation system may be configured to drive heated air through the cooking chamber 102 to maintain a steady cooking temperature within the cooking chamber 102. The typical airflow path can be seen from FIGS. 3-5. In this regard, FIG. 3 shows a perspective view of the cooking chamber 102 in cross section taken along a plane that passes through the cooking chamber 102 from front to back in accordance with an example embodiment. The airflow path can also be seen in reference to FIG. 4A, which shows a front view looking inside the cooking chamber 102 to a back wall of the cooking chamber 102, and FIG. 4B, which isolates the back wall of the cooking chamber 102. FIG. 4C illustrates an alternative structure for the back wall of the cooking chamber 102 and also shows how the rack 110 may be positioned relative to the structures in the back wall that correspond to the chamber outlet port 120 and the air delivery orifices 112. FIG. 5 illustrates another cross section view taken from the right side of the oven 100.

Referring primarily to FIGS. 3, 4A, 4B, 4C, and 5, a fan assembly 300 includes an impeller 310 that draws air from the cooking chamber 102 and into a plenum 320. Inside the plenum 320, heating coils 322 heat the air to a desired temperature. The heated air is then distributed back into the cooking chamber 102. In this arrangement, it should be appreciated that the fan assembly 300 is one example implementation of the airflow generator 212 of FIG. 2. Similarly, the heating coils 322 are one example implementation of the air heater 214 of FIG. 2.

The fan assembly 300 may draw air into the plenum 320 through outlet perforations 330 in a back wall 340 of the cooking chamber 102. The outlet perforations 330 may define the outlet port 120. The outlet perforations 330 may be substantially aligned with the impeller 310 of the fan assembly 300 to provide an outlet of air from the cooking chamber 102 and into the plenum 320. The fan assembly 300 may include a centrifugal fan. As such, the operation of the impeller 310 may create a low pressure region within the cooking chamber 102 proximate to the outlet perforations 330 to draw air into the impeller 310. The impeller 310 may impart a force on the air that has been drawn therein and force the air outwardly from an axis of the impeller 310 into the plenum 320. Thus, the plenum 320 may be a higher pressure region relative to the pressure of the cooking chamber 102. The higher pressure in the plenum 320 may then cause the air to pass proximate to the heating coils 322 to increase the temperature of the air prior to the heated air being pushed back into the cooking chamber 102 via the air delivery orifices 112.

The air delivery orifices 112 may be provided in a back wall 340 of the cooking chamber 102. The cooking chamber 102 may be further defined by a top wall 342, a bottom wall 344, a right sidewall 346 and a left sidewall 348. In some examples, the air delivery orifices 112 may be formed by a first set of inlet perforations 350 disposed at a top portion of the back wall 340 (e.g., proximate to the top wall 342) and a second set of inlet perforations 355 disposed at a bottom portion of the back wall 340 (e.g., proximate to the bottom wall 344. The first and second sets of inlet perforations 350 and 355 may provide an inlet path for heated air into the cooking chamber 102 from the plenum 320 based on the higher pressure created in the plenum 320 by operation of the fan assembly 300. The first and second sets of inlet perforations 350 and 355 and the outlet perforations 330 may be formed from individual perforations that are sized to block any escape of RF energy (at the frequencies employed during operation of the oven 100) from the cooking chamber 102.

Figure 4A:
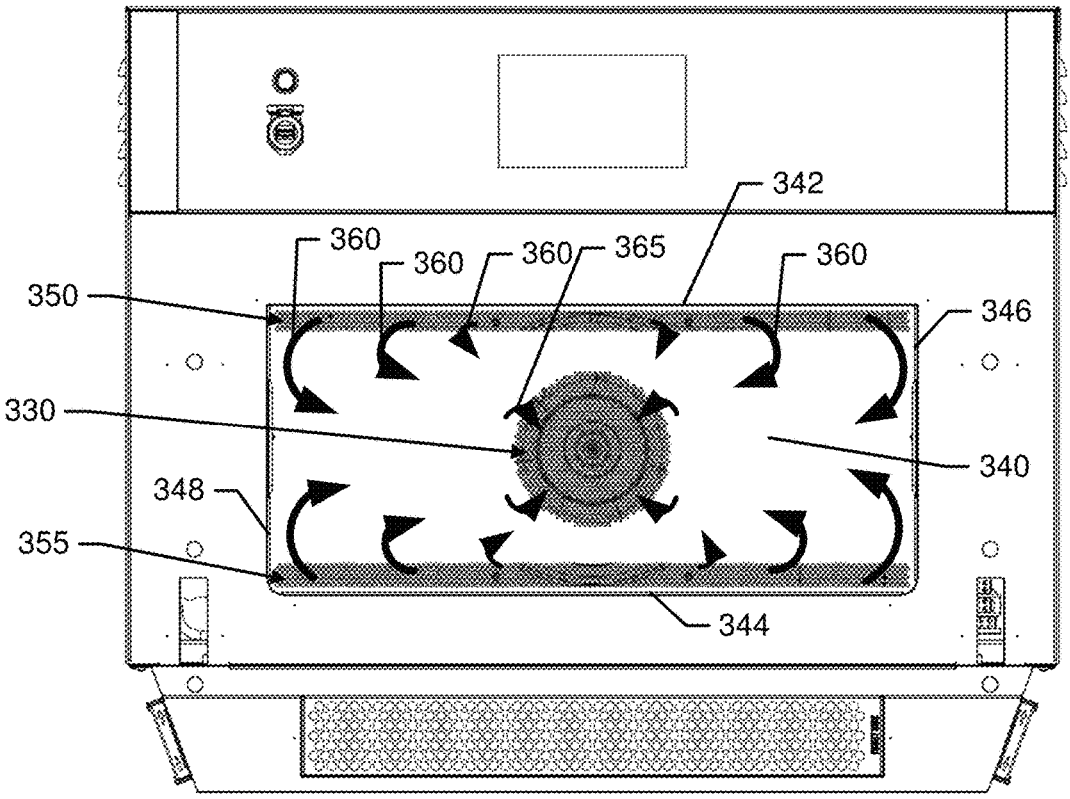
FIG. 4A illustrates a front view looking inside the cooking chamber to a back wall of the cooking chamber according to an example embodiment.
Figure 5:
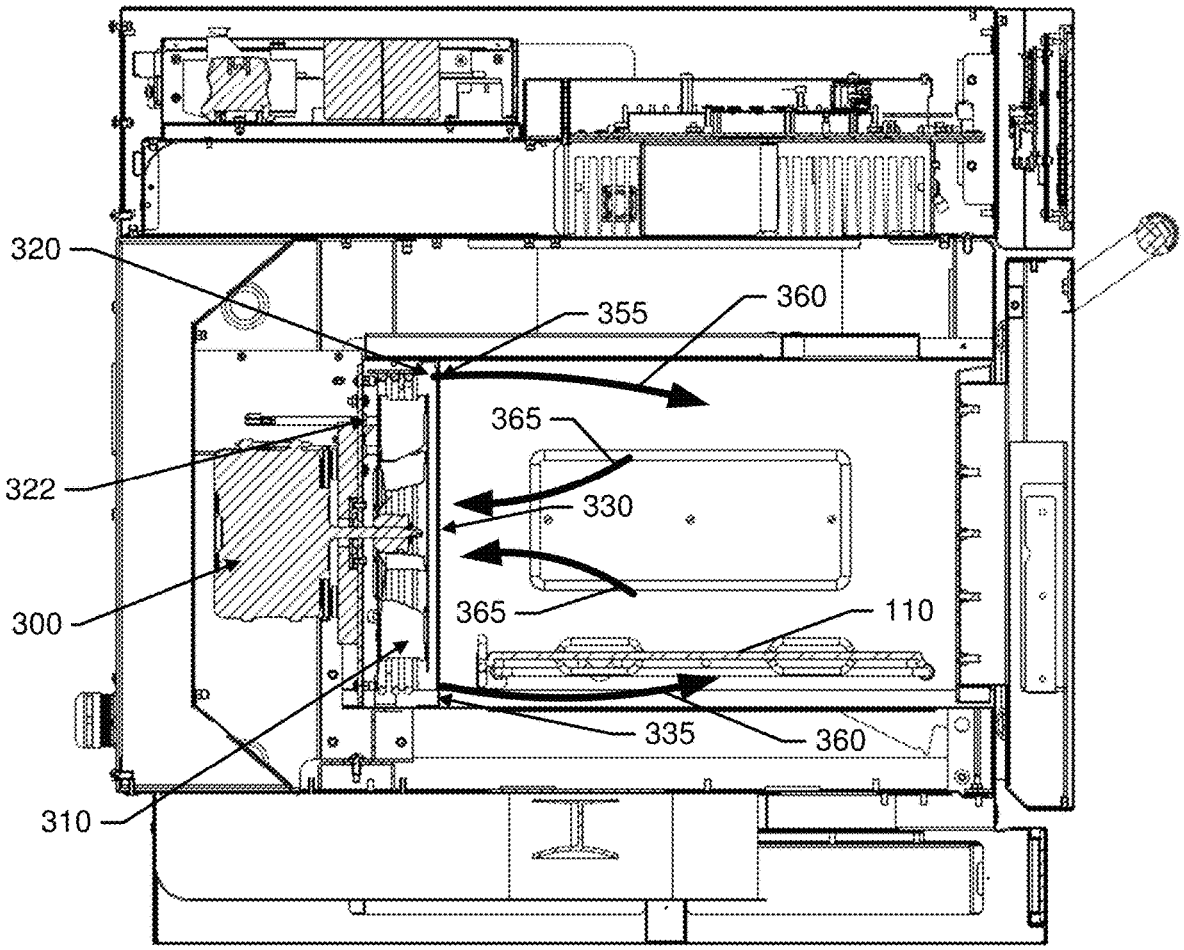
FIG. 5 illustrates another cross section view taken from the right side of the oven according to an example embodiment.

As best seen in FIG. 4A, the first set of inlet perforations 350 may extend such that opposing ends thereof are proximate to the right and left sidewalls 346 and 348. Moreover, the opposing ends of the first set of inlet perforations 350 are approximately equidistant from the right and left sidewalls 346 and 348, and the distance between each opposing end of the first set of inlet perforations 350 is substantially equal to the distance between the top edge of the first set of inlet perforations 350 and the top wall 342. Similarly, the second set of inlet perforations 355 may extend such that opposing ends thereof are proximate to the right and left sidewalls 346 and 348. Moreover, the opposing ends of the second set of inlet perforations 355 are approximately equidistant from the right and left sidewalls 346 and 348, and the distance between each opposing end of the second set of inlet perforations 355 is substantially equal to the distance between the bottom edge of the second set of inlet perforations 355 and the bottom wall 344. In some cases, the second set of inlet perforations 355 may also be closer to the bottom of the outlet perforations 330 than the first set of inlet perforations 350 is to the top of the outlet perforations. Thus, the center of the outlet perforations 330 (or axis of the impeller 310) may be closer to the second set of inlet perforations 355 than the first set of inlet perforations 350.

Figure 4B:
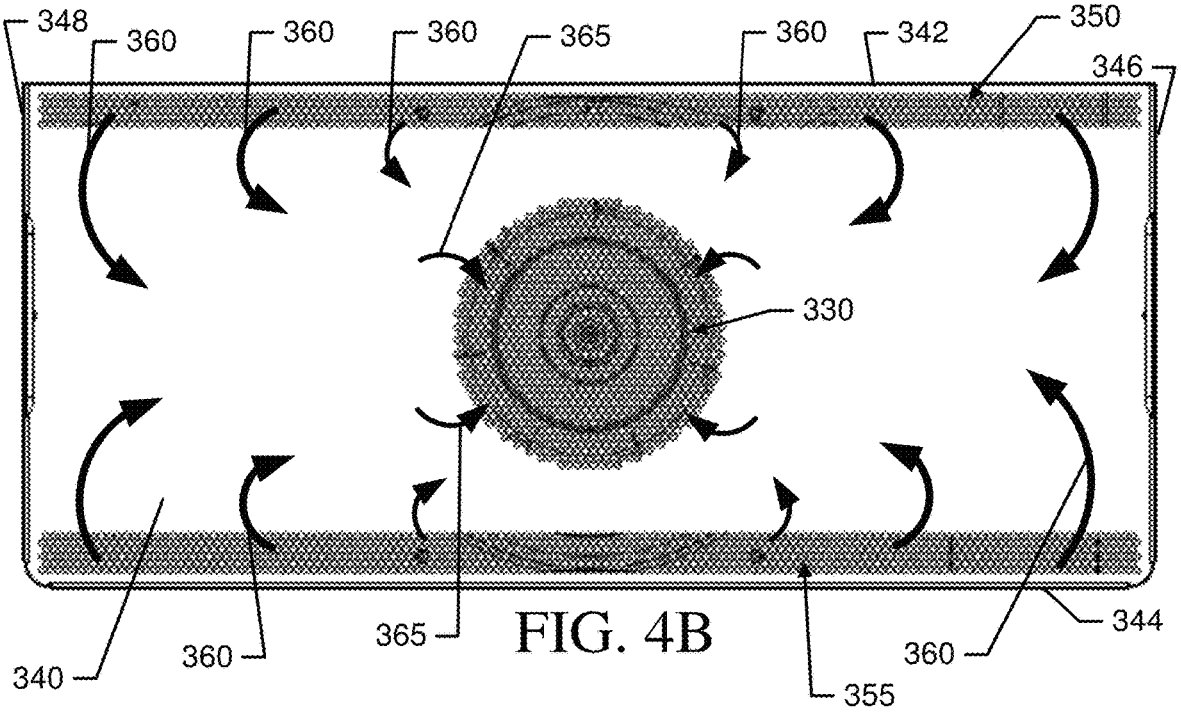
FIG. 4B is an isolation view of only the back wall of the cooking chamber to illustrate perforations therein and flow paths through the back wall according to an example embodiment.
Figure 4C:
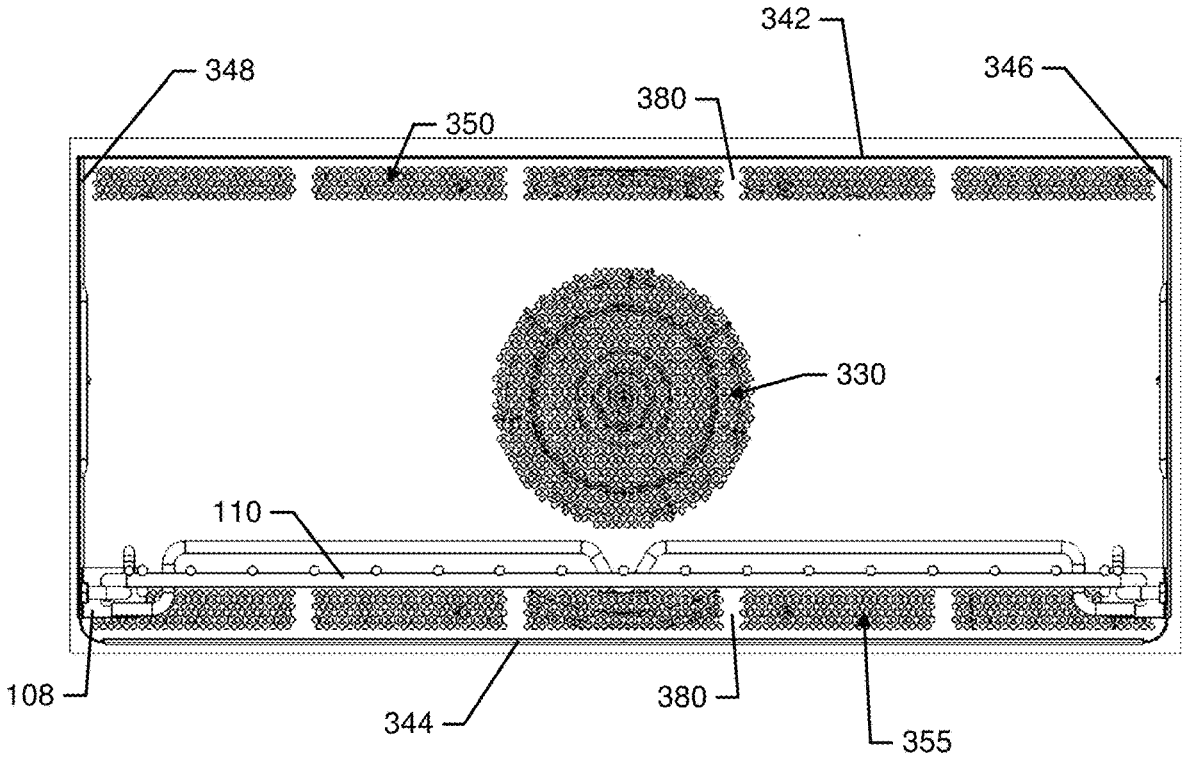
FIG. 4C illustrates an alternative structure for the back wall of the cooking chamber in accordance with an example embodiment.

FIGS. 4A and 4B illustrate the flow paths described above. In this regard, heated air 360 (represented by arrows having the reference number 360 in FIGS. 4A and 4B) is provided from the plenum 320 and into the cooking chamber 102 via the first and second sets of inlet perforations 350 and 355. Meanwhile, exhaust air 365 (represented by arrows having the reference number 365 in FIGS. 4A and 4B) is drawn from the cooking chamber 102 and into the plenum 320 via the outlet perforations 330. Although the arrows of FIGS. 4A and 4B are of different sizes, the sizes do not necessarily imply corresponding flowrates. Instead, the arrows merely show movement of some of the air within the cooking chamber 102. However, it should also be appreciated that the pressure in the plenum 320, which forces air into the cooking chamber 102, also causes the air to move laterally forward (i.e., toward the viewer).

The first and second sets of inlet perforations 350 and 355 may be split into two separate strips of perforations that extend linearly across the top and bottom of the back wall of the cooking chamber 102. The strips of perforations may be further formed from individual rows of perforations that extends linearly along a direction substantially parallel to the plane in which the bottom (or top) of the cooking chamber 102 lies. In some cases, the number of rows of perforations that form the strip of perforations near the bottom of the cooking chamber 102 may be larger than the number of rows of perforations that form the strip of perforations near the top of the cooking chamber 102 to provide more flow circulation from the bottom and directed upward than the amount of flow circulation directed from the top and downward. In an example embodiment, the number of rows of perforations that form the strip of perforations near the bottom of the cooking chamber 102 may be six and the number of rows of perforations that form the strip of perforations near the top of the cooking chamber 102 may be five. However, other arrangements are also possible.

As can be seen in FIGS. 4A and 4B, the outlet perforations 330 may be disposed in the back wall 340 to form a geometric shape (e.g., a circle) that is different than the geometric shapes of the first and second inlet perforations 350 and 355 (e.g., rectangles). However, in spite of these shape differences, the overall area of inlet and outlet sections may be about equal in some examples. That said, in some alternative cases, it may be desirable to make the area of the outlet perforations 330 larger than the combined areas of the first and second inlet perforations 350 and 355 (e.g., to reduce the pressure or flow rate of air moving into the cooking chamber 102), or to make the area of the outlet perforations 330 smaller than the combined areas of the first and second inlet perforations 350 and 355 (e.g., to increase the pressure or flow rate of air moving into the cooking chamber 102).

As shown primarily in FIGS. 4A and 4B, the outlet perforations 330 may be formed into a circular shape to substantially match the size of the inlet of the fan assembly 300 to the impeller 310. Meanwhile, the first and second sets of inlet perforations 350 and 355 are linearly shaped to substantially match the size and/or shape of the top and bottom of the cooking chamber 102. Due to the force of the impeller 310 driving the air inside the plenum 320 outwardly, in some cases, the magnitude of airflow of heated air 360 may be larger as you get farther away from the outlet perforations 330. Or at least in some cases, the magnitude of airflow of heated air 340 may be relatively small at portions of the first and second sets of inlet perforations 350 and 355 that are closest to the outlet perforations 330. For this reason, in some cases, instead of being continuous strips of perforations, the first and second sets of inlet perforations 350 and 355 may be split into two or more parts by one or more divider portions.

FIG. 4C illustrates an example of a back wall employing multiple divider portions. In the example of FIG. 4C, a number of reinforcement bars 380 may be provided to increase the strength of the back wall 340. The reinforcement bars 380 may add to the overall strength and rigidity of the back wall 340, and may also concentrate flow in portions of the first and second sets of inlet perforations 350 and 355 where the reinforcement bars 380 are not provided. In some cases, the reinforcement bars 380 may be positioned closest to peripheral edges of the outlet perforations 330. In other words, reinforcement bars 380 may be positioned at least at a middle portion of the first and second sets of inlet perforations 350 and 355 since flow may generally be low in this location anyway.

The air circulated through first air circulation system may be controlled based on user inputs defined at the interface panel 106 either directly or indirectly (e.g., by selection of a cooking program or recipe). Thus, for example, both the air temperature and the fan speed may be selected, and operation of the fan assembly 300 and the heating coils 322 may be controlled accordingly by the control electronics 220.

Although the actual path of air in the cooking chamber 102 is not the subject of this disclosure, it should be appreciated that some aspects of the structures provided, and the division of flows induced thereby, can impact the cooking process in positive ways. For example, if a large flowrate of air is inserted into the cooking chamber 102 that impacts the food product from the side, the impact on the food product may disrupt the rising of the food product or result in uneven cooking or browning of the food product. Accordingly, by inserting the air into the cooking chamber 102 exclusively near the top and bottom walls 342 and 344, the air may project into the cooking chamber 102 at an elevation that does not directly impinge upon the food from the side. Instead, the air may project into the cooking chamber 102 and then fall or rise toward the middle to be drawn out through the outlet perforations. Additionally, the provision of larger area for the second set of inlet perforations 355 than the first set of inlet perforations 350 coupled with the fact that the space where there are no perforations between the first set of inlet perforations 350 and the outlet perforations 330 is larger than the space between the second set of inlet perforations 355 and the outlet perforations 330 may provide increased flow from below the food product. Given that heat naturally rises, better internal flow and heating characteristics may be achieved by providing more flow (e.g., as much as 30% more) into the cooking chamber 102 at a low elevation (e.g., via the second set of inlet perforations 355). The second set of inlet perforations 355 may therefore be located at a low elevation (e.g., proximate to the bottom wall 344) where the food product is generally at least partially shielded from direct contact with the hot air by a container placed on the rack 110 to hold the food product. Although some portions of the second set of inlet perforations 355 may extend to a higher elevation than the rack 110, in some cases, the second set of inlet perforations 355 may be entirely positioned below the elevation of the rack 110 and/or rack supports 108. This may facilitate a reduction or elimination of side impact of hot air on the food product and provide more even heating at the bottom of any container placed on the rack 110.

In an example embodiment, an oven may be provided. The oven may include a cooking chamber configured to receive a food product, and an air circulation system configured to provide heated air into the cooking chamber. The air circulation system may include a plenum disposed proximate to the cooking chamber and separated from the cooking chamber by a back wall of the cooking chamber, an airflow generator configured to draw air from the cooking chamber through a chamber outlet port and discharge the air into the plenum, and an air heater configured to heat at least some of the air in the plenum prior to a portion of the air entering the cooking chamber from the plenum via air delivery orifices. The chamber outlet port includes outlet perforations combining to form a first geometric shape centered on an axis of the airflow generator. The air delivery orifices include a first set of inlet perforations and a second set of inlet perforations. The first and second sets of inlet perforations combine to form respective second and third geometric shapes that are disposed on opposite sides of the outlet perforations. The second and third geometric shapes are different than the first geometric shape.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the cooking chamber comprises a top wall, a bottom wall, a right sidewall and a left sidewall. In such an example, the first set of inlet perforations may extend proximate to the top wall between the right sidewall and the left sidewall, and the second set of inlet perforations may extend proximate to the bottom wall between the right sidewall and the left sidewall. In an example embodiment, a distance between a top of the first set of perforation inlets and the top wall may be about equal to both a distance between a first end of the first set of inlet perforations and the right sidewall and a distance between a second end of the first set of inlet perforations and the left sidewall. Similarly, a distance between a bottom of the second set of perforation inlets and the bottom wall may be about equal to both a distance between a first end of the second set of inlet perforations and the right sidewall and a distance between a second end of the second set of inlet perforations and the left sidewall. In an example embodiment, the second and third geometric shapes may each be rectangular, and the first geometric shape may be circular. In such an example, an area of the outlet perforations may be substantially equal to a combined area of the first set of inlet perforations and the second set of inlet perforations. Additionally or alternatively, an area of the first set of inlet perforations may be smaller than an area of the second set of inlet perforations, and the second set of inlet perforations may be closer to the outlet perforations than the first set of inlet perforations. In an example embodiment, a rack for supporting the food product is disposed within the cooking chamber at elevation higher than a top of the second set of inlet perforations and lower than a bottom of the outlet perforations. In some cases, a diameter of the first geometric shape may be about one fourth of a length of each of the first and second sets of inlet perforations. In an example embodiment, one or more reinforcement bars may be disposed between portions of at least one of the first set of inlet perforations or the second set of inlet perforations. In some cases, the oven further comprises an RF heating system configured to provide RF energy into the cooking chamber using solid state electronic components. In such an example, individual perforations of the output perforations and both the first and second sets of inlet perforations may be sized to block escape of RF through the individual perforations.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product; and an air circulation system configured to provide heated air into the cooking chamber, wherein the air circulation system comprises:

a plenum separated from the cooking chamber by a back wall of the cooking chamber, an airflow generator configured to draw air from the cooking chamber through a chamber outlet port and discharge the air into the plenum, and an air heater configured to heat at least some of the air in the plenum prior to a portion of the air entering the cooking chamber from the plenum via air delivery orifices, wherein the chamber outlet port comprises outlet perforations combining to form a first geometric shape centered on an axis of the airflow generator, wherein the air delivery orifices comprise a first set of inlet perforations disposed near a top wall of the cooking chamber and a second set of inlet perforations disposed near a bottom wall of the cooking chamber, each of the first set of inlet perforations and the second set of inlet perforations comprising individual rows of perforations that extend linearly along a direction substantially parallel to a plane in which the bottom wall or the top wall of the cooking chamber lies, the first set of inlet perforations and the second set of inlet perforations combining to form respective second and third geometric shapes that are disposed on opposite sides of the outlet perforations, wherein the second and third geometric shapes are different than the first geometric shape, wherein a number of the individual rows forming the second set of inlet perforations is larger than the number of the individual rows forming the first set of inlet perforations, and wherein a center of the outlet perforations is closer to the second set of inlet perforations than the first set of inlet perforations.

2. The oven of claim 1, wherein the cooking chamber further comprises a right sidewall and a left sidewall, and wherein the first set of inlet perforations extends between the right sidewall and the left sidewall, and the second set of inlet perforations extends between the right sidewall and the left sidewall.

3. The oven of claim 2, wherein a distance between a top of the first set of perforation inlets and the top wall is substantially equal to both a distance between a first end of the first set of inlet perforations and the right sidewall and a distance between a second end of the first set of inlet perforations and the left sidewall, and wherein a distance between a bottom of the second set of perforation inlets and the bottom wall is substantially equal to both a distance between a first end of the second set of inlet perforations and the right sidewall and a distance between a second end of the second set of inlet perforations and the left sidewall.

4. The oven of claim 1, wherein the second and third geometric shapes are each rectangular, and the first geometric shape is circular.

5. The oven of claim 4, wherein an area of the outlet perforations is substantially equal to a combined area of the first set of inlet perforations and the second set of inlet perforations.

6. The oven of claim 1, wherein a rack for supporting the food product is disposed within the cooking chamber at elevation higher than a top of the second set of inlet perforations and lower than a bottom of the outlet perforations.

7. The oven of claim 4, wherein a diameter of the first geometric shape is one fourth of a length of each of the first set of inlet perforations and the second set of inlet perforations.

8. The oven of claim 1, wherein the oven further comprises a radio frequency (RF) heating system configured to provide RF energy into the cooking chamber using solid state electronic components, and wherein individual perforations of the outlet perforations and both the first set of inlet perforations and the second set of inlet perforations are sized to block escape of RF through the individual perforations.

9. An air circulation system for an oven comprising a cooking chamber configured to receive a food product, the air circulation system comprising:

a plenum separated from the cooking chamber by a back wall of the cooking chamber;

an airflow generator configured to draw air from the cooking chamber through a chamber outlet port and discharge the air into the plenum; and an air heater configured to heat at least some of the air in the plenum prior to a portion of the air entering the cooking chamber from the plenum via air delivery orifices;

wherein the chamber outlet port comprises outlet perforations combining to form a first geometric shape centered on an axis of the airflow generator, wherein the air delivery orifices comprise a first set of inlet perforations disposed near a top wall of the cooking chamber and a second set of inlet perforations disposed near a bottom wall of the cooking chamber, each of the first set of inlet perforations and the second set of inlet perforations comprising individual rows of perforations that extend linearly along a direction substantially parallel to a plane in which the bottom wall or the top wall of the cooking chamber lies, the first set of inlet perforations and the second set of inlet perforations combining to form respective second and third geometric shapes that are disposed on opposite sides of the outlet perforations, wherein the second and third geometric shapes are different than the first geometric shape, wherein a number of the individual rows forming the second set of inlet perforations is larger than the number of the individual rows forming the first set of inlet perforations, and wherein a center of the outlet perforations is closer to the second set of inlet perforations than the first set of inlet perforations.

10. The air circulation system of claim 9, wherein the cooking chamber further comprises a right sidewall and a left sidewall, and wherein the first set of inlet perforations extends between the right sidewall and the left sidewall, and the second set of inlet perforations extends between the right sidewall and the left sidewall.

11. The air circulation system of claim 10, wherein a distance between a top of the first set of perforation inlets and the top wall is substantially equal to both a distance between a first end of the first set of inlet perforations and the right sidewall and a distance between a second end of the first set of inlet perforations and the left sidewall, and wherein a distance between a bottom of the second set of perforation inlets and the bottom wall is substantially equal to both a distance between a first end of the second set of inlet perforations and the right sidewall and a distance between a second end of the second set of inlet perforations and the left sidewall.

12. The air circulation system of claim 9, wherein the second and third geometric shapes are each rectangular, and the first geometric shape is circular.

13. The air circulation system of claim 12, wherein an area of the outlet perforations is substantially equal to a combined area of the first set of inlet perforations and the second set of inlet perforations.

14. The air circulation system of claim 9, wherein a rack for supporting the food product is disposed within the cooking chamber at elevation higher than a top of the second set of inlet perforations and lower than a bottom of the outlet perforations.

15. The air circulation system of claim 12, wherein a diameter of the first geometric shape is about one fourth of a length of each of the first set of inlet perforations and the second set of inlet perforations.

16. The air circulation system of claim 9, wherein the oven further comprises a radio frequency (RF) heating system configured to provide RF energy into the cooking chamber using solid state electronic components, and wherein individual perforations of the outlet perforations and both the first set of inlet perforations and the second set of inlet perforations are sized to block escape of RF through the individual perforations.

* * * * *